US006024506A

United States Patent [19]

Eum et al.

[11] Patent Number: 6,024,506

[45] Date of Patent: Feb. 15, 2000

[54] PRINTING APPARATUS FRAME STRUCTURE HAVING A DAMPING MEMBER FOR ABSORBING VIBRATIONS

[75] Inventors: Jae-yong Eum, Suwon; Ho-dong Kim, Yongin, both of Rep. of Korea

[73] Assignee: Samsung Electronics Co., Ltd., Kyungki-do, Rep. of Korea

[21] Appl. No.: 09/100,982

[22] Filed: Jun. 22, 1998

[30] Foreign Application Priority Data

Jan. 26, 1998 [KR] Rep. of Korea ..... 98-2411

[51] Int. Cl.[7] ..... B41J 29/08

[52] U.S. Cl. ..... 400/691; 400/693

[58] Field of Search ..... 400/691, 692, 400/693, 689; 399/107, 110

[56] References Cited

U.S. PATENT DOCUMENTS

| | | | |
|---|---|---|---|
| 1,778,503 | 10/1930 | Lord | 267/141.2 |
| 2,351,725 | 6/1944 | Wack | 400/691 X |
| 2,489,696 | 11/1949 | Boyden | 400/691 X |
| 4,713,714 | 12/1987 | Gatti et al. | 360/137 |
| 5,026,186 | 6/1991 | Hasegawa et al. | 400/691 |

FOREIGN PATENT DOCUMENTS

| | | |
|---|---|---|
| 56-133170 | 10/1981 | Japan . |
| 59-101370 | 6/1984 | Japan . |
| 61-140854 | 9/1986 | Japan . |
| 63-122545 | 5/1988 | Japan . |
| 3-290260 | 12/1991 | Japan . |

*Primary Examiner*—Edgar Burr
*Assistant Examiner*—Minh H. Chau
*Attorney, Agent, or Firm*—Sughrue, Mion, Zinn, Macpeak & Seas, PLLC

[57] ABSTRACT

A frame structure of a printing apparatus is provided with a main frame having a developer unit and a paper supply and output unit, a subframe installed in the main frame, having a printing unit, and a damping member installed between the main frame and the subframe, for absorbing vibration which would otherwise be transferred from the main frame to the subframe. Thus, the damping member can prevent the vibration generated by the developer unit or the paper supply and output unit from being transferred to the printing unit.

4 Claims, 6 Drawing Sheets

PRINTING APPARATUS FRAME STRUCTURE HAVING A DAMPING MEMBER FOR ABSORBING VIBRATIONS

BACKGROUND OF THE INVENTION

1. Field of the Invention

The present invention relates to a frame structure of a printing apparatus, and more particularly, to a frame structure capable of preventing vibration of peripheral apparatus from being transferred to a printing unit.

2. Description of the Related Art

As shown in FIG. 1, a printing apparatus such as a color laser printer includes a frame 10 forming a main body. The frame 10 includes a paper supply and output unit for supplying and outputting paper, a printing unit 40 for printing an image on supplied paper, and a developer unit 30 for supplying a developer to the printing unit 40. Also, the paper supply and output unit includes a paper cassette 21, a paper manual feeding portion 22 and a paper output portion 23.

Thus, in the printing operation, the paper is supplied to the printing unit 40 through the paper cassette 21 or the paper manual feeding portion 22, and the printing unit 40 receives the developer from the developer unit 30 to print a desired image on the supplied paper.

However, vibration to the printing unit is caused by the developer unit 30 and the paper supply and output unit which include, respectively, a multitude of pumps 31 for supplying the developer, and a multitude of driving motors (not shown) for transferring the paper. These motors cause vibration in the above frame structure, which are transferred to the printing unit 40. Specifically, the printing unit 40, the developer unit 30 and the paper supply and output unit are installed on a single frame 10, so that vibration generated by one of the units is transferred to other units via the frame 10. The vibration causes problems in the printing unit 40 during printing. For instance, if the printing unit 40 is severely vibrated during printing, the image printed on the paper is distorted or the shading of the transferred developer is not uniform.

SUMMARY OF THE INVENTION

To solve the above problems, an object of the present invention is to provide a frame structure of a printing apparatus having an improved structure in which vibrations of a peripheral apparatus can be prevented from being transferred to a printing unit.

To achieve the above objective, a frame structure of a printing apparatus includes: a main frame having a developer unit for storing and supplying a predetermined developer, and a paper supply and output unit for supplying and outputting paper; a subframe installed in the main frame, having a printing unit for receiving the developer to print an image on paper supplied by the paper supply and output unit; and a damping member installed between the main frame and the subframe, for absorbing vibration which would otherwise be transferred from the main frame to the subframe.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
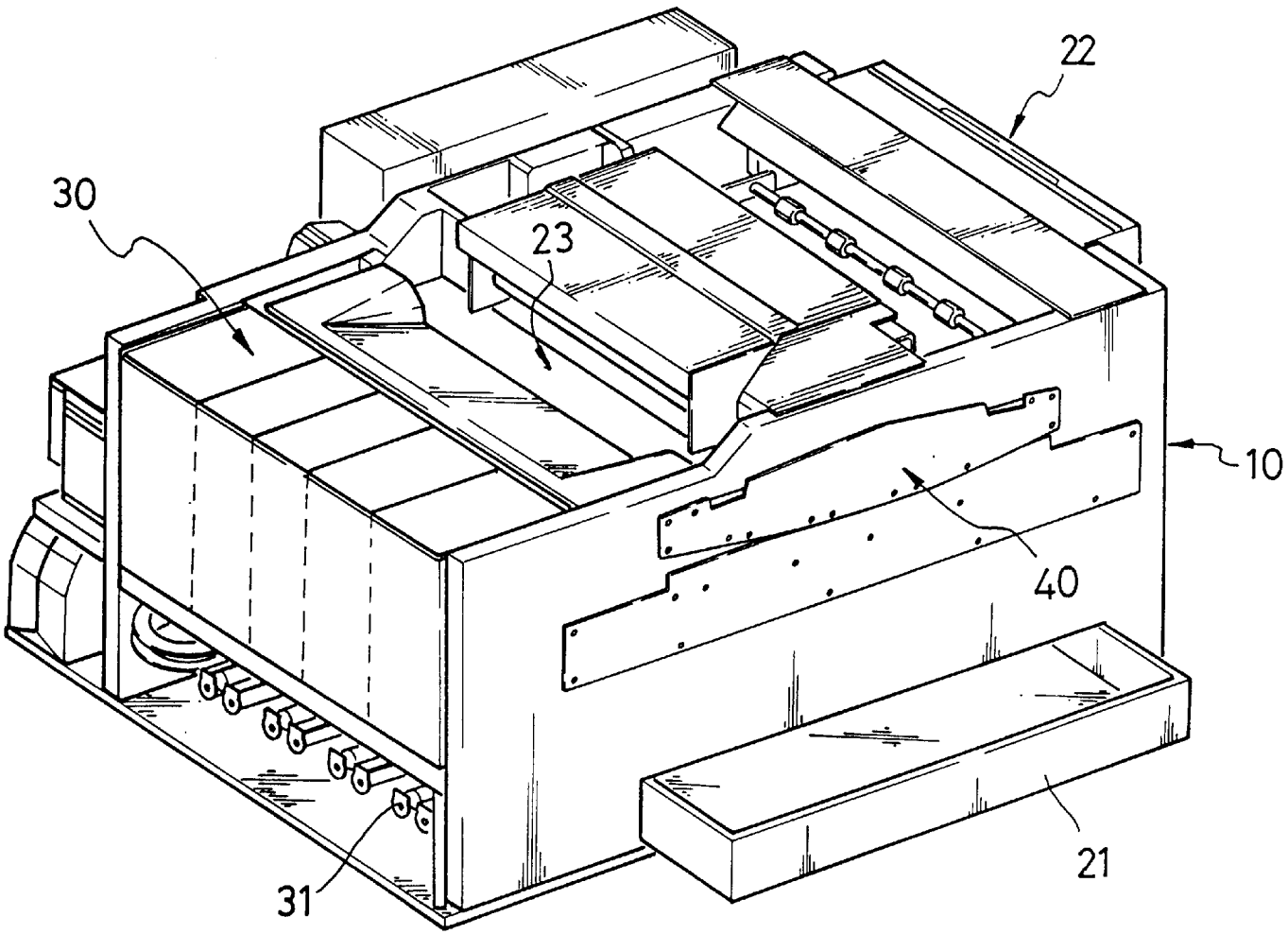
FIG. 1 (PRIOR ART)
FIG. 1 is a perspective view of a frame structure of a conventional printing apparatus.
Figure 2:
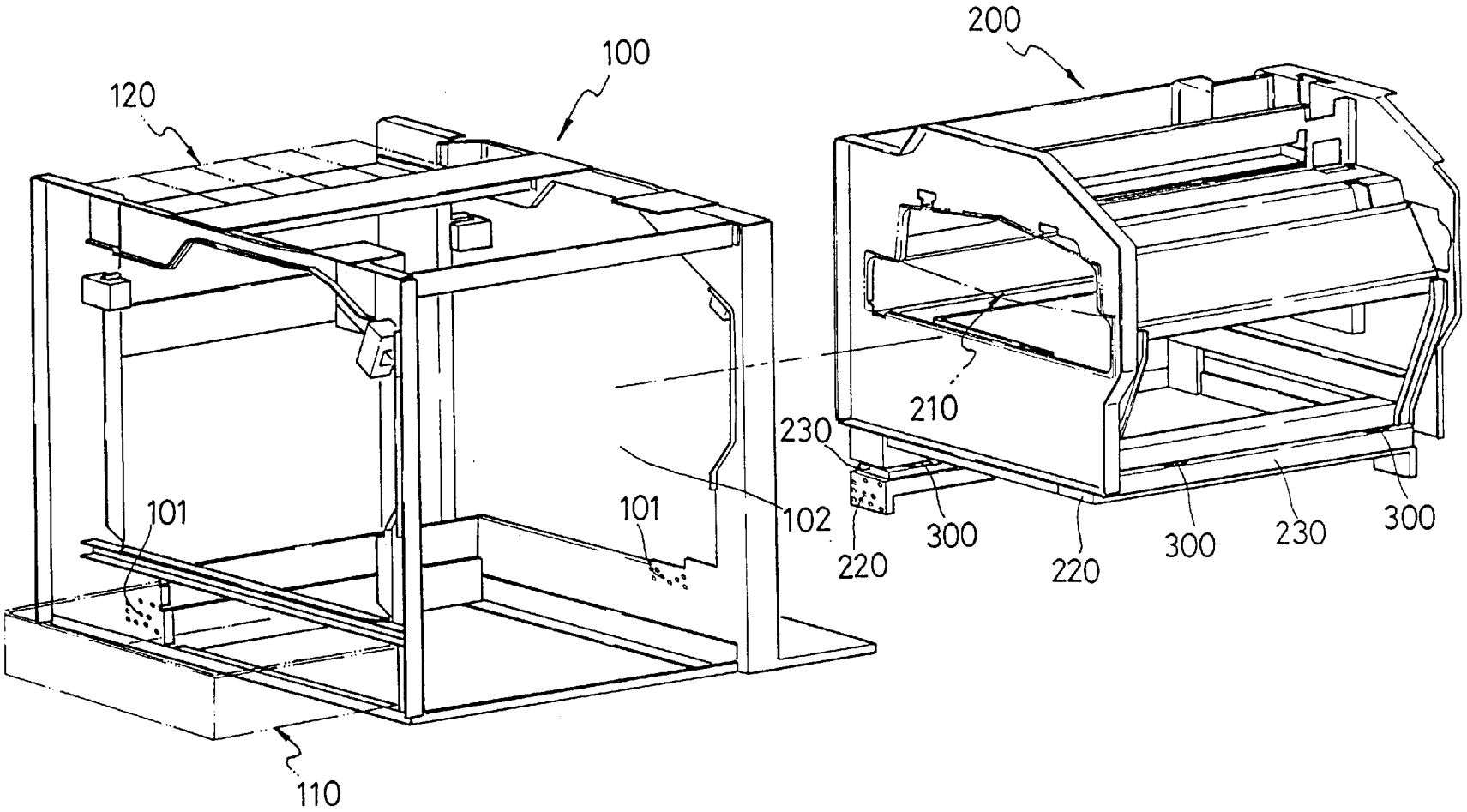
FIG. 2 is a perspective view of a frame structure of a printing apparatus according to a first embodiment of the present invention.
Figure 3:
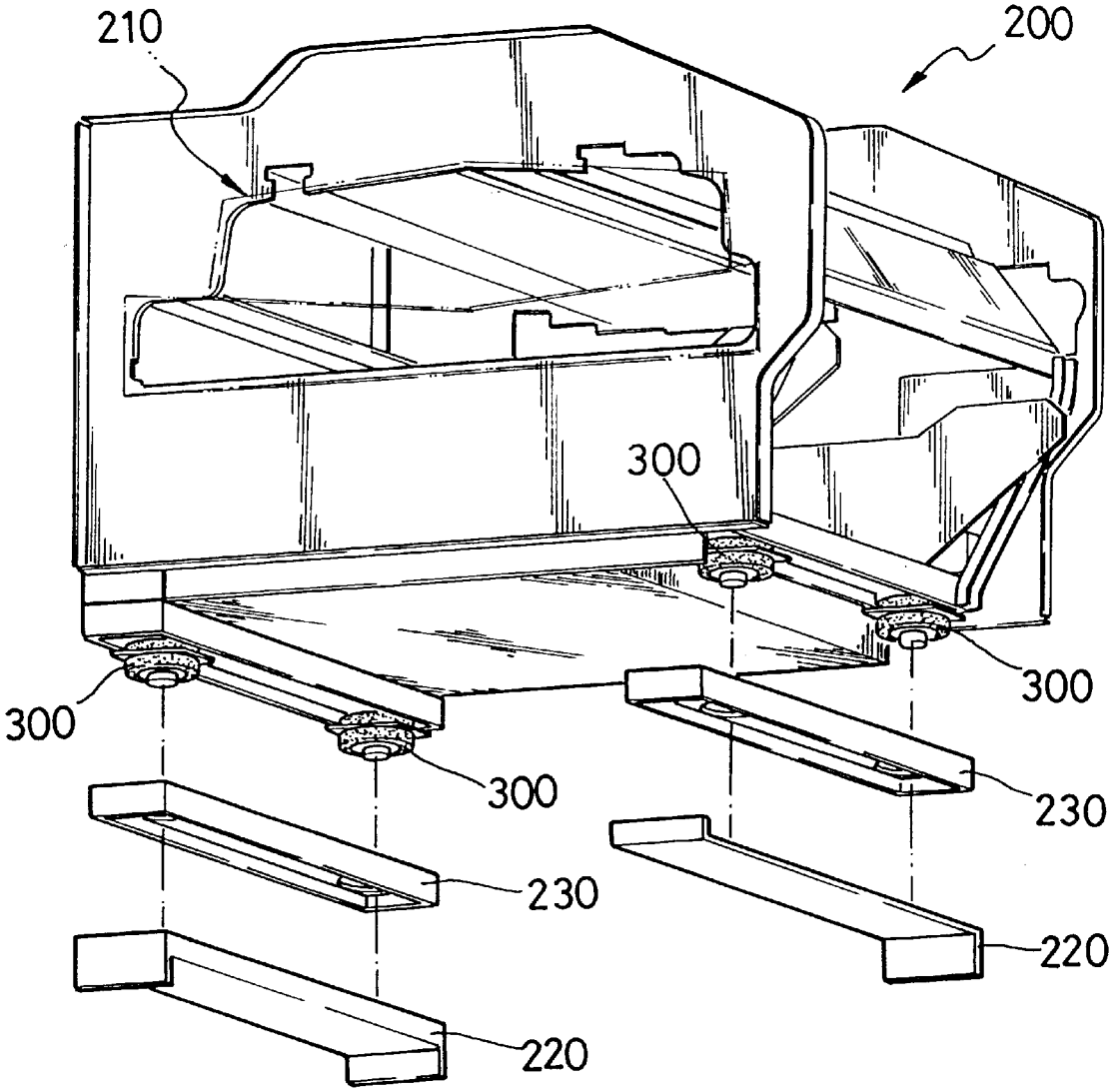
FIG. 3 is a perspective view of a subframe in the frame structure of FIG. 2.
Figure 4:
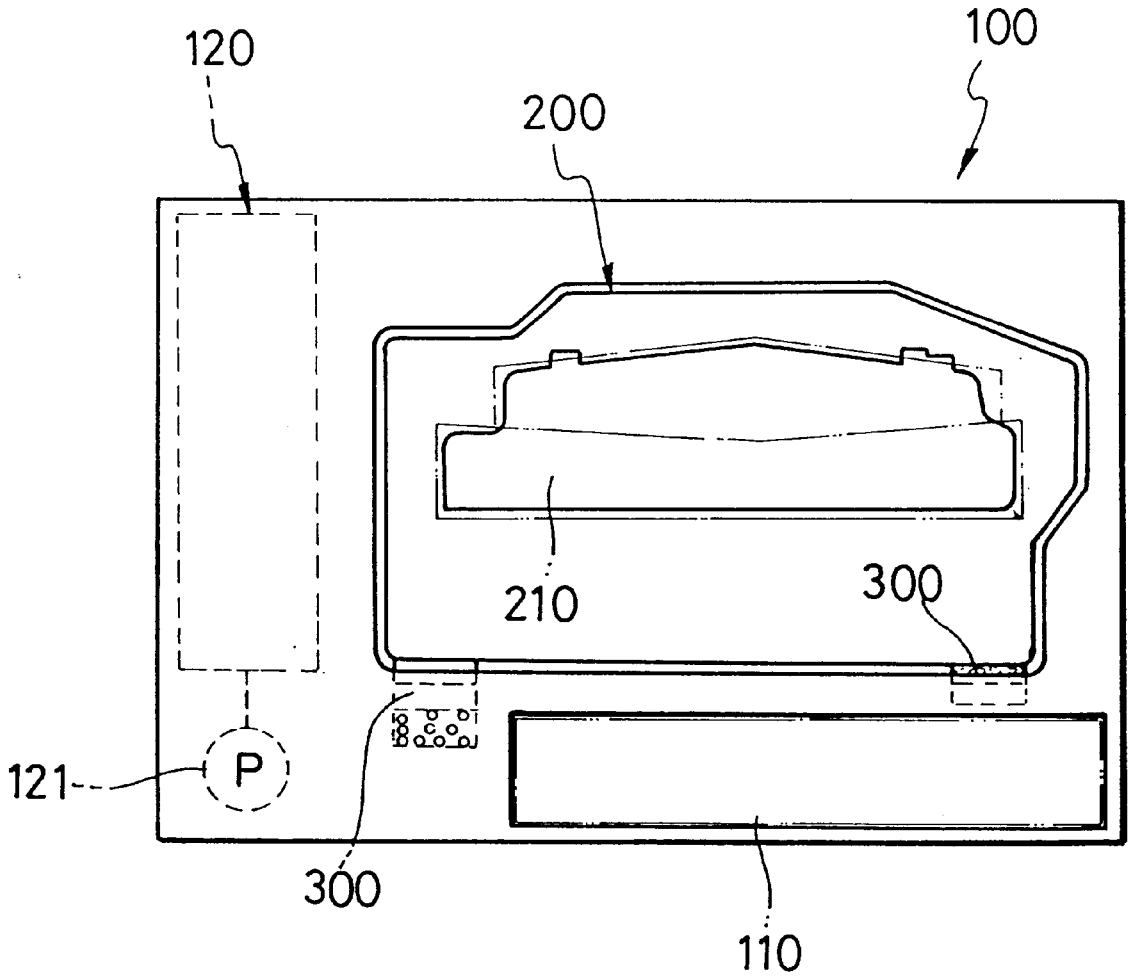
FIG. 4 is a side view of a connection state in the frame structure of FIG. 2.

FIGS. 2–4 show a frame structure of a printing apparatus according to a first embodiment of the present invention.

The frame structure according to the present invention, as shown in FIGS. 2 and 3, includes a main frame 100 and a subframe 200 which can be separated from each other. The main frame 100 includes a paper supply and output unit, including a paper cassette 110, and a developer unit 120, and the subframe 200 includes a printing unit 210. The subframe 200 is inserted into a space 102 of the main frame 100, and a fixing member 220 connected to the bottom surface of the subframe 200 is connected to a connection portion 101 formed on the main frame 100, to thereby connect the two frames 100 and 200 to each other. Also, a plurality of damping members 300 for absorbing vibration, and a protection member 230 for protecting the damping member 300, are provided above the fixing member 220. Thus, the damping member 300 is connected to the bottom surface of the subframe 200 and contacts the top surface of the fixing member 220. Thus, as shown in FIG. 4, the main frame 100 is connected to the lower portion of the subframe 200 via the damping member 300, but the other surfaces are spaced apart from the subframe by a predetermined distance. In other words, the main frame 100 and the subframe 200 are connected to each other only through the lower portion of the subframe 200, including the damping member 300. Preferably, the damping member 300 is formed of rubber.

According to the above structure, the main frame 100 and the subframe 200 are connected to each other only through a portion on which the damper 300 is installed, so that much less vibration is generated by a pump 121 of a developer unit 120 in the main frame 100 and transferred to the printing unit 210 than in the conventional art. Also, the vibration transferred to the subframe 200 is absorbed to the damper 300, to thereby suppress transfer of the vibration to the printing unit 210. In other words, the printing unit 210 is installed in an independent subframe 200, and the developer unit 120 and the paper supply and output unit which have a multitude of vibration sources are installed in the main frame 100, and the damping member 300 for absorbing vibration is installed in the connection portion between the main frame 100 and the subframe 200, to thereby sufficiently suppress the vibration transferred to the printing unit 210. Thus, distortion of an image or non-uniformity of shading of the developer can be suppressed.

Figure 5:
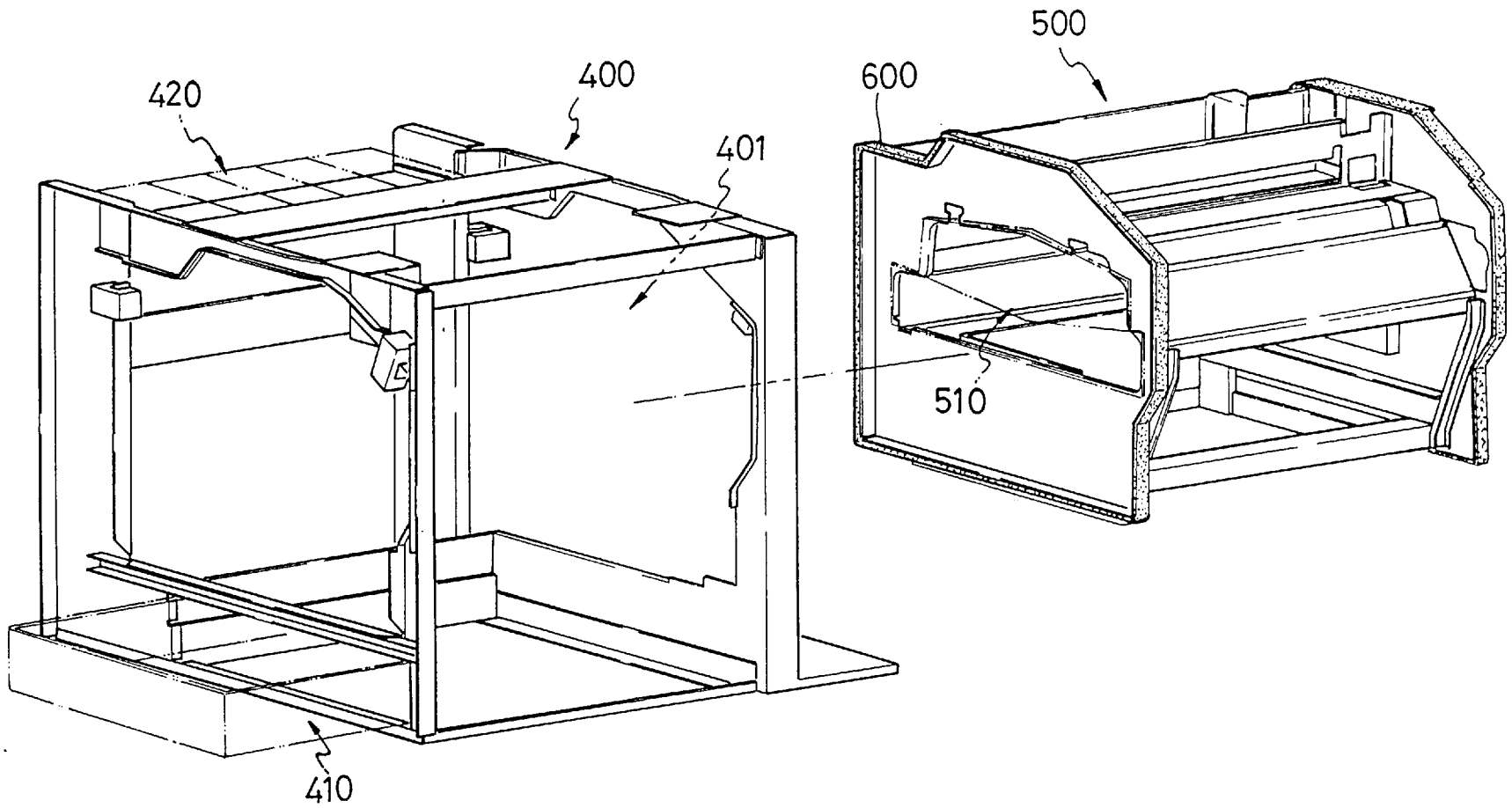
FIG. 5 is a perspective view of a frame structure of a printing apparatus according to a second embodiment of the present invention.
Figure 6:
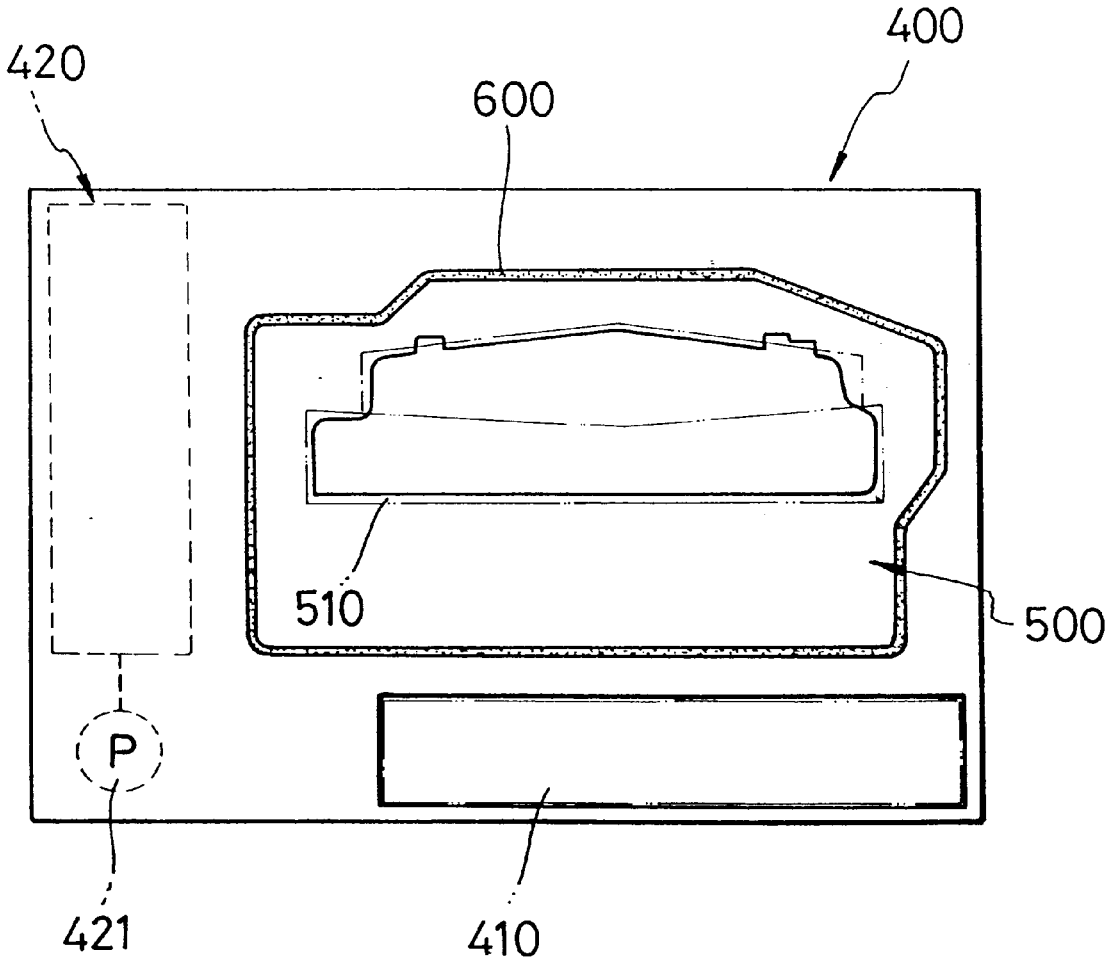
FIG. 6 is a perspective view of a connection state in the frame structure of FIG. 5.

FIGS. 5 and 6 show a frame structure of a printing apparatus according to a second embodiment of the present invention.

In the second embodiment, an outer surface of a subframe 500 contacting a main frame 400 is surrounded with a flat damping member 600, and the subframe 500 is inserted into a space 401 of the main frame 400. In this state, vibration which is generated by peripheral apparatus installed in the main frame 400, such as a pump 421 of a developer unit 420, or a driving motor (not shown) of the paper supply and output unit including the paper cassette 410, and transferred to the subframe 500, is absorbed by the damping member 600 surrounding the contacting portion. In other words, the flat damping member 600 surrounds the portion of the subframe 500 which contacts the main frame 400, thus absorbing the vibration transferred to the printing unit 510.

Therefore, in the frame structure according to the present embodiment, the vibration of a peripheral apparatus can be prevented from being transferred to the printing unit 510.

According to the above frame structure of the present invention, the printing unit is installed in the independent subframe, and the damping member is installed between the subframe and the main frame, so that the vibration generated by the developer unit and the paper supply and output unit can be prevented from being transferred to the printing unit.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A frame structure of a printing apparatus comprising:

a main frame having a developer unit for storing and supplying a predetermined developer, and a paper supply and output unit for supplying and outputting paper;

a subframe installed in the main frame, having a printing unit for receiving the developer to print an image on paper supplied by the paper supply and output unit; and a damping member installed between the main frame and the subframe, for absorbing vibration of the main frame, so as to prevent a transfer of vibration from the main frame to the subframe, wherein a fixing member is connected to the main frame and installed on the bottom surface of the subframe, and the damping member is installed between the fixing member and the subframe, wherein only the bottom portion of the subframe is connected to the main frame, by the damping member and the fixing member.

2. The frame structure of claim 1, wherein the damping member is formed of rubber.

3. A frame structure of a printing apparatus comprising:

a main frame having a developer unit for storing and supplying a predetermined developer, and a paper supply and output unit for supplying and outputting paper;

a subframe installed in the main frame, having a printing unit for receiving the developer to print an image on paper supplied bv the paper supply and output unit; and a damping member installed between the main frame and the subframe, for absorbing vibration of the main frame, so as to prevent a transfer of vibration from the main frame to the subframe, wherein the damping member surrounds an outer portion of the subframe which contacts the main frame, so that the subframe and the main frame only contact each other via the damping member and wherein the damping member is formed in one continuous piece which surrounds the outer portion of the subframe on four sides of the subframe.

4. The frame structure of claim 3, wherein the damping member has a flat shape so that the damping member contacts the outer portion of the subframe and an inner surface of the main frame which faces the outer portion of the subframe.

* * * * *